US010731279B2

(12) United States Patent
Cox et al.

(10) Patent No.: US 10,731,279 B2
(45) Date of Patent: Aug. 4, 2020

(54) KNITTED COMPONENTS REINFORCED WITH HIGH TENACITY YARN

(71) Applicant: NIKE, Inc., Beaverton, OR (US)

(72) Inventors: Lauren E. Cox, Beaverton, OR (US); Seth M. Wiberg, Beaverton, OR (US); Roberto Zavala, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 275 days.

(21) Appl. No.: 15/876,116

(22) Filed: Jan. 20, 2018

(65) Prior Publication Data

US 2019/0226128 A1 Jul. 25, 2019

(51) Int. Cl.

*D04B 1/12* (2006.01)
*D04B 1/24* (2006.01)
*D04B 1/10* (2006.01)

(52) U.S. Cl.

CPC ..... *D04B 1/123* (2013.01); *D04B 1/24* (2013.01); *D04B 1/104* (2013.01); *D10B 2501/043* (2013.01)

(58) Field of Classification Search

CPC ... D04B 1/14; D04B 1/22; D04B 1/24; D04B 1/12; D04B 1/123; D04B 1/16; A43B 1/04; A43B 3/0036; A43B 23/0225

See application file for complete search history.

(56) References Cited

U.S. PATENT DOCUMENTS 4,276,671 A * 7/1981 Melton ..... A41B 11/007 12/142 T
6,116,059 A * 9/2000 Rock ..... A43B 1/04 66/191
6,161,400 A * 12/2000 Hummel ..... A41D 19/01505 66/174
6,862,902 B1 * 3/2005 Kim ..... A41B 11/005 66/178 R
8,448,474 B1 * 5/2013 Tatler ..... A43B 23/0245 66/64
8,621,891 B2 * 1/2014 Dua ..... A43B 23/0245 66/177
9,365,960 B2 * 6/2016 Craig ..... D04B 1/26

(Continued)

FOREIGN PATENT DOCUMENTS

TW 201514354 A 4/2015
WO WO 2010/080182 A1 7/2010

(Continued)

OTHER PUBLICATIONS

International Search Report and Written Opinion for International Patent Application No. PCT/US2019/012822 dated Apr. 2, 2019; 14 pages.

(Continued)

*Primary Examiner* — Danny Worrell

(74) *Attorney, Agent, or Firm* — Brinks Gilson & Lione

(57) ABSTRACT

Knitted components may include a first knit layer including a first yarn, a second knit layer, and a plurality of inlaid courses of a high tenacity yarn having a tenacity of at least six grams-force per denier. The plurality of inlaid courses of the high tenacity yarn may include at least three courses of high tenacity yarn, each of which may be separated from an adjacent course of the first plurality of courses of the high tenacity yarn by no more than five courses of the first yarn.

18 Claims, 8 Drawing Sheets

(56) References Cited

U.S. PATENT DOCUMENTS

| | | | | |
|---|---|---|---|---|
| 9,725,835 | B2 * | 8/2017 | Vaglio Tessitore | D04B 1/16 |
| 10,316,441 | B2 * | 6/2019 | Ly | D04B 1/02 |
| 10,458,052 | B2 * | 10/2019 | Adami | B29C 70/44 |
| 2005/0193592 | A1 | 9/2005 | Dua | |
| 2006/0134351 | A1 | 6/2006 | Greene | |
| 2009/0092830 | A1 * | 4/2009 | Chitrangad | D01D 10/02 428/364 |
| 2010/0050699 | A1 * | 3/2010 | Kolmes | A41B 9/00 66/174 |
| 2010/0154256 | A1 * | 6/2010 | Dua | A43B 1/04 36/25 R |
| 2012/0233882 | A1 | 9/2012 | Huffa | |
| 2012/0246973 | A1 * | 10/2012 | Dua | A43B 23/0235 36/83 |
| 2013/0145652 | A1 | 6/2013 | Podhajny et al. | |
| 2014/0237861 | A1 * | 8/2014 | Podhajny | A43B 1/04 36/9 R |
| 2014/0245632 | A1 * | 9/2014 | Podhajny | A43B 1/04 36/45 |
| 2014/0245634 | A1 * | 9/2014 | Podhajny | A43B 23/0265 36/54 |
| 2014/0310983 | A1 * | 10/2014 | Tamm | A43B 23/024 36/83 |
| 2015/0107307 | A1 * | 4/2015 | Kosui | D04B 1/22 66/177 |
| 2015/0216256 | A1 | 8/2015 | Podhajny | |
| 2015/0374062 | A1 * | 12/2015 | Ikenaka | A43B 1/04 12/142 G |
| 2016/0029736 | A1 | 2/2016 | Meir | |
| 2016/0066651 | A1 * | 3/2016 | Terai | D04B 1/24 36/45 |
| 2017/0202295 | A1 * | 7/2017 | MacGilbert | A43B 1/04 |
| 2017/0238644 | A1 | 8/2017 | Meir | |
| 2017/0342612 | A1 * | 11/2017 | Kawakami | A43B 23/02 |

FOREIGN PATENT DOCUMENTS

| | | | |
|---|---|---|---|
| WO | WO 2015/038243 | A1 | 3/2015 |
| WO | WO 2016/168046 | A2 | 10/2016 |
| WO | WO 2016/168046 | A3 | 10/2016 |

OTHER PUBLICATIONS

Non-Final Office Action dated Feb. 13, 2020 for U.S. Appl. No. 15/876,117; 10 pages.

Office Action for Taiwan Patent Application No. 108101919 dated Feb. 4, 2020.

* cited by examiner

KNITTED COMPONENTS REINFORCED WITH HIGH TENACITY YARN

BACKGROUND

The present disclosure relates generally to knitted components and methods of manufacturing knitted components, for example, knitted components for use in footwear applications.

SUMMARY

According to one aspect of the present disclosure, a knitted component may include a first knit layer including a first yarn, a second knit layer, and a first plurality of inlaid courses of a high tenacity yarn having a tenacity of at least six grams-force per denier. The first plurality of inlaid courses of the high tenacity yarn may include at least three courses of high tenacity yarn, each of which may be separated from an adjacent course of the first plurality of courses of the high tenacity yarn by no more than five courses of the first yarn. At least one course of the first plurality of inlaid courses of the high tenacity yarn may have a diameter of less than or equal to 0.9 mm. The first plurality of courses of the high tenacity yarn may include at least five courses of the high tenacity yarn. Each course of the first plurality of inlaid courses of the high tenacity yarn may have a linear density of at least 1,000 denier. Each course of the first plurality of courses of the high tenacity yarn may have a maximum tensile strength of at least 7,000 grams-force. The knitted component may further include a second plurality of inlaid courses of the high tenacity yarn having a tenacity of at least six grams-force per denier. At least one course of the first plurality of inlaid courses may extend from a first edge toward a second edge, and at least one course of the second plurality of inlaid courses may extend from the second edge toward a third edge. At least one course of the first plurality of inlaid courses may extend from a first edge toward a second edge, and at least one course of the second plurality of inlaid courses may extend from the second edge toward the first edge. At least one course of the first plurality of inlaid courses may extend part way to the second edge, and at least one course of the second plurality of inlaid courses may extend part way to the first edge. At least one course of the first plurality of inlaid courses may extend past the at least one course of the second plurality of inlaid courses. The at least one course of the first plurality of inlaid courses may extend from the first edge to the second edge. The first knit layer may conceal one or more of the plurality of inlaid courses. The first knit layer and the second knit layer may be at least partially formed from the first yarn. At least one course of the plurality of inlaid courses may be secured to at least one of the first and second knit layers with a tuck stitch. The high tenacity yarn and the first yarn may have at least one different visual property, for example different colors. The knitted component may further include a plurality of openings formed in the first knit layer, through which an exposed portion of the plurality of inlaid courses of the high tenacity yarn may be visible from a first viewpoint facing the first knit layer. The exposed portion may be recessed relative to a first surface of the first knit layer. The plurality of openings may form a pattern, at least a portion of which may have an orientation other than a course-wise direction.

According to another aspect of the present disclosure, a method of forming a knitted component may include knitting a first course of a first yarn on a first needle bed and a second needle bed, inlaying a first course of a high tenacity yarn having a tenacity of at least six grams-force per denier in between the first and second needle beds, inlaying a second course of the high tenacity yarn in between the first and second needle beds, and inlaying a third course of the high tenacity yarn in between the first and second needle beds. The first and second courses of the high tenacity yarn may be separated from each other by no more than five courses, and the second and third courses of the high tenacity yarn may be separated from each other by no more than five courses.

According to another aspect of the present disclosure, an article of footwear may include a knitted component defining at least part of a void and joined with a sole structure. The knitted component may include an interior knit layer, an exterior knit layer, a plurality of inlaid courses of a high tenacity yarn between the interior and exterior knit layers. The plurality of inlaid courses of high tenacity yarn may include at least three courses of the high tenacity yarn, each of which may be separated from an adjacent course of the plurality by no more than five courses. At least one course of the plurality of inlaid courses of the high tenacity yarn may have a diameter of less than or equal to 0.9 mm. The high tenacity yarn may have a tenacity of at least six grams-force per denier. The plurality of inlaid courses may be at least partially located on at least one of a lateral side and a medial side of the article. The plurality of inlaid courses may be at least partially located in a midfoot region of the article, and/or at least partially located adjacent to a throat region of the article, and/or at least partially located in a forefoot region of the article, and/or at least partially located on the lateral side and the medial side of the article, and/or at least partially located in a rearfoot region. The plurality of inlaid courses may extend from a lateral edge to a medial edge. The plurality of inlaid courses may extend substantially throughout the knitted component. The plurality of inlaid courses may be at least partially located in at least one of a heel region and a toe box region of the article, and/or at least partially located on at least one of a medial side and a lateral side of the article, and/or may extend from the heel region to the toe box region.

According to another aspect of the present disclosure, an article of footwear may include a knitted component defining at least part of a void and a sole structure joined with the knitted component. The article of footwear may include a first plurality of courses of a high tenacity yarn inlaid between an interior knit layer and an exterior knit layer. The first plurality may include at least three courses, at least two of which may be spaced apart by no more than five courses of the exterior knit layer. The article may include a second plurality of courses of the high tenacity yarn inlaid between the interior knit layer and the exterior knit layer, which may be located in a different location of the knitted component from the first plurality. At least one of the first plurality and the second plurality of courses of the high tenacity yarn may be at least partially located on at least one of a medial side and a lateral side of the article. At least one of the first plurality and the second plurality of courses of the high tenacity yarn may be at least partially located in a rearfoot region of the article. At least one of the first plurality and the second plurality of courses of the high tenacity yarn may be at least partially located in a heel region of the article. At least one of the first plurality and the second plurality of courses of the high tenacity yarn may be at least partially located in a midfoot region of the article. At least one of the first plurality and the second plurality of courses of the high tenacity yarn may be at least partially located in a forefoot region of the article. At least one of the first plurality and the second plurality of courses of the high tenacity yarn may be at least partially located in a toe box region of the article. At least one course of at least one of the first plurality and the second plurality of courses of the high tenacity yarn may be secured to the sole structure. A plurality of lace apertures may extend through at least one of the first plurality and second plurality of courses of the high tenacity yarn. The exterior knit layer may include a plurality of openings, through which an exposed portion of at least one of the first plurality and the second plurality of courses of the high tenacity yarn may be visible. The exterior knit layer may include a plurality of elongate and parallel knit structures.

Other systems, methods, features and advantages of the present disclosure will be, or will become, apparent to one with skill in the art upon examination of the following figures and detailed description. It is intended that all such additional systems, methods, features and advantages be within the scope of the present disclosure, and be encompassed by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like-referenced numerals designate corresponding parts throughout the different views.

DETAILED DESCRIPTION OF THE PREFERRED EMBODIMENTS

Figure 1:
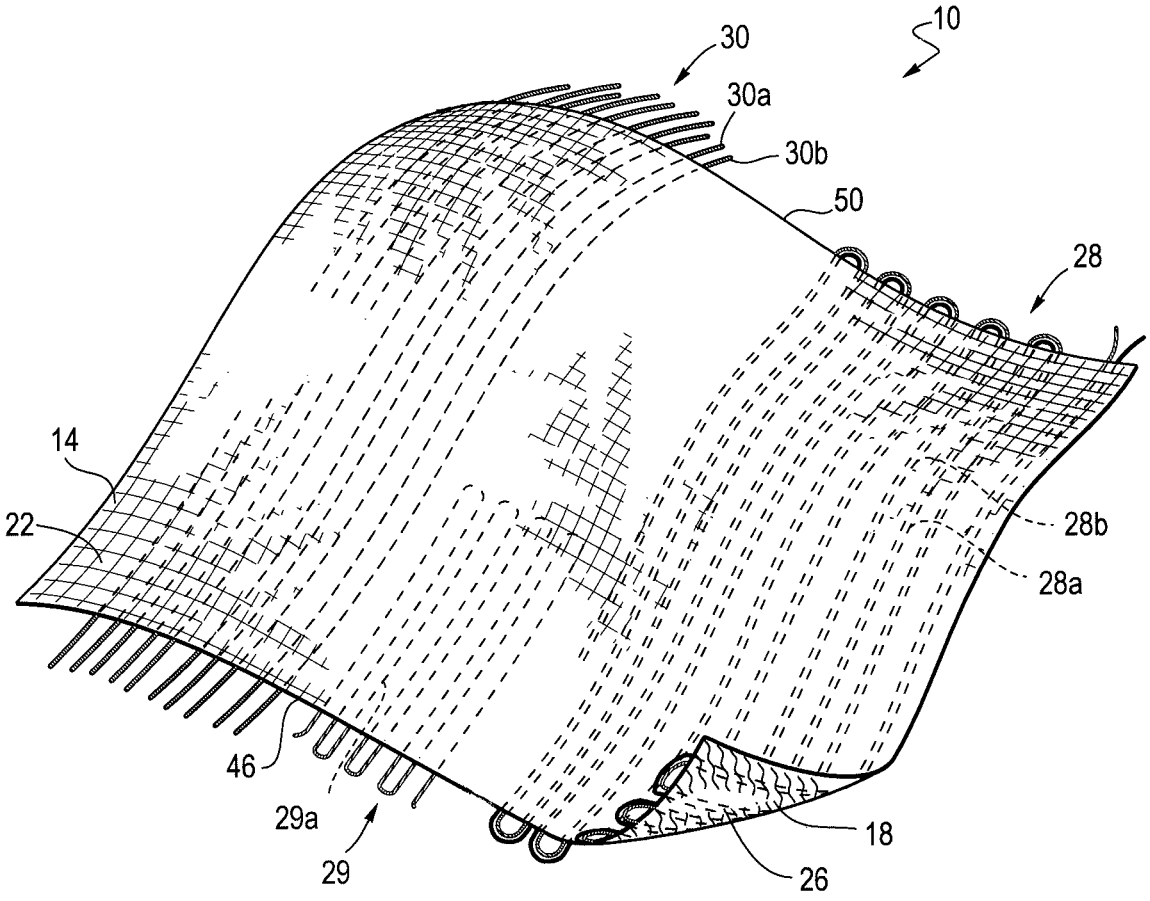
FIG. 1 shows a knitted component according to one aspect.

Referring to FIG. 1, a knitted component 10 suitable for a number of applications, e.g., footwear, apparel, and industrial textiles, is shown. The knitted component 10 may be formed as an integral one-piece element from a single knitting process, such as a weft knitting process (e.g., with a flat knitting machine with one, two, or more needle beds, or with a circular knitting machine), a warp knitting process, or any other suitable knitting process. The process that forms knitted component 10 may be a hybrid knitting process, in that one or more materials that form knitted component 10 are not knitted. For example, one or more materials (e.g., yarns or strands) of knitted component 10 may be inlaid. As used in this application, a yarn may include a strand, and is not intended to limit the present disclosure to multifilament materials. The process that forms knitted component 10 may substantially form the knit structure of knitted component 10 without the need for significant post-knitting processes or steps. Alternatively, two or more portions of knitted component 10 may be formed separately as distinct integral one-piece elements, and then the respective elements may be attached. In all of the aforementioned cases, the resulting knitted component may be have integral knit construction.

Knitted component 10 may include at least a first layer 14 and a second layer 18. First layer 14 and second layer 18 may be formed on one or more needle beds of a knitting machine, e.g., a first needle bed and/or a second needle bed. When one or both of first and second layers 14, 18 are formed on more than one needle bed, or when first and second layers 14, 18 are formed on different needle beds, then resulting knitted component 10 is a multi-bed knitted component. As used in this application, first layer 14 may form a first surface 22 comprising a first plurality of knit loops, and second layer 18 may form a second surface 26 comprising a second plurality of knit loops. First layer 14 may overlap at least a portion of second layer 18, and first and second layers 14, 18 may be coterminous in one or more dimensions; however, first and second layer 14, 18 need not be coterminous. At least a portion of first layer 14 may be freely separable from second layer 18. In other words, first layer 14 and second layer 18 may have one or more portions with opposite facing surfaces, thereby making those portions of first layer 14 freely separable from second layer 18. That is, first surface 22 may generally face a first direction, and second surface 26 may generally face the opposite direction. Although first layer 14 may be freely separable from second layer 18 in certain areas, it need not be freely separable. For example, knitted component 10 may include one or more interlayer knit stitches (e.g., stitches formed during the same knitting process and extending between a first needle bed and a second needle bed). Such interlayer knit stitches may be formed by the same yarn(s) that forms the first and/or second layers 14, 18, or a different yarn. In one example, at least one course of yarn may form a portion of both first layer 14 and second layer 18, e.g., a knit structure formed on both first and second needle beds that includes the first plurality of knit loops on the first surface 22 and the second plurality of loops on the second surface 26. For example, in an interlock knit structure or similar structure that includes one or more courses having loops formed on both a first and a second needle bed, each course may form at least a part of both the first and second layers 14, 18. Alternatively, different courses of yarn may form the first and second layers 14, 18, e.g., a first course may form a single jersey first layer on a first needle bed and a second course may form a single jersey second layer on a second needle bed, where at least a portion of the single jersey first layer is separable from the single jersey second layer (as in FIGS. 4A, B). Knitted component 10 may include additional layers, e.g., to add cushioning, protection, or for other advantages. In various applications, first layer 14 or second layer 18 may correspond with at least part of an outer or inner layer of an article of apparel or industrial textile, an exterior or interior layer of an upper for an article of footwear, or other application.

First and second layers 14, 18 may each include one or more materials selected to impart advantageous properties to knitted component 10. For example, first layer 14 may eventually correspond with an exterior layer of an article of footwear, such as when the article has been assembled and is configured to accommodate the foot of a wearer, and therefore may include courses of a relatively inelastic first yarn providing abrasion resistance, water resistance and/or durability. Suitable materials for first layer 14 may include polyester yarns, e.g., polyester yarns having a maximum tensile strength of at least approximately 0.5 kg-f (e.g., ranging from approximately 0.5 kg-f to approximately 3.0 kg-f) and a linear density of at least approximately 150 denier (e.g., ranging from approximately 150 to approximately 1,500 denier). First layer 14 may also be weatherized, e.g., it may be formed from yarns having water repellant and or resistant properties or it may have a durable water repellent finish.

The second layer 18 may eventually correspond with an interior layer of an article of footwear, such as when the article has been assembled and is configured to accommodate the foot of a wearer, and therefore, the second layer 18 may include one or more courses of yarn having a relatively soft hand, for example a yarn having a napped finish or otherwise provide breathability and comfort to the wearer. Additionally or alternatively, second layer 18 may include one or more elasticized yarns to give resiliency to the knitted component. The examples are non-limiting and are intended to illustrate the versatility of first and second layers 14, 18 which may be formed from the same yarn(s) or different yarns or a combination thereof to provide advantageous properties to the respective layers, and/or different portions, areas or regions of the respective layers, as necessary or desired.

Figure 2:
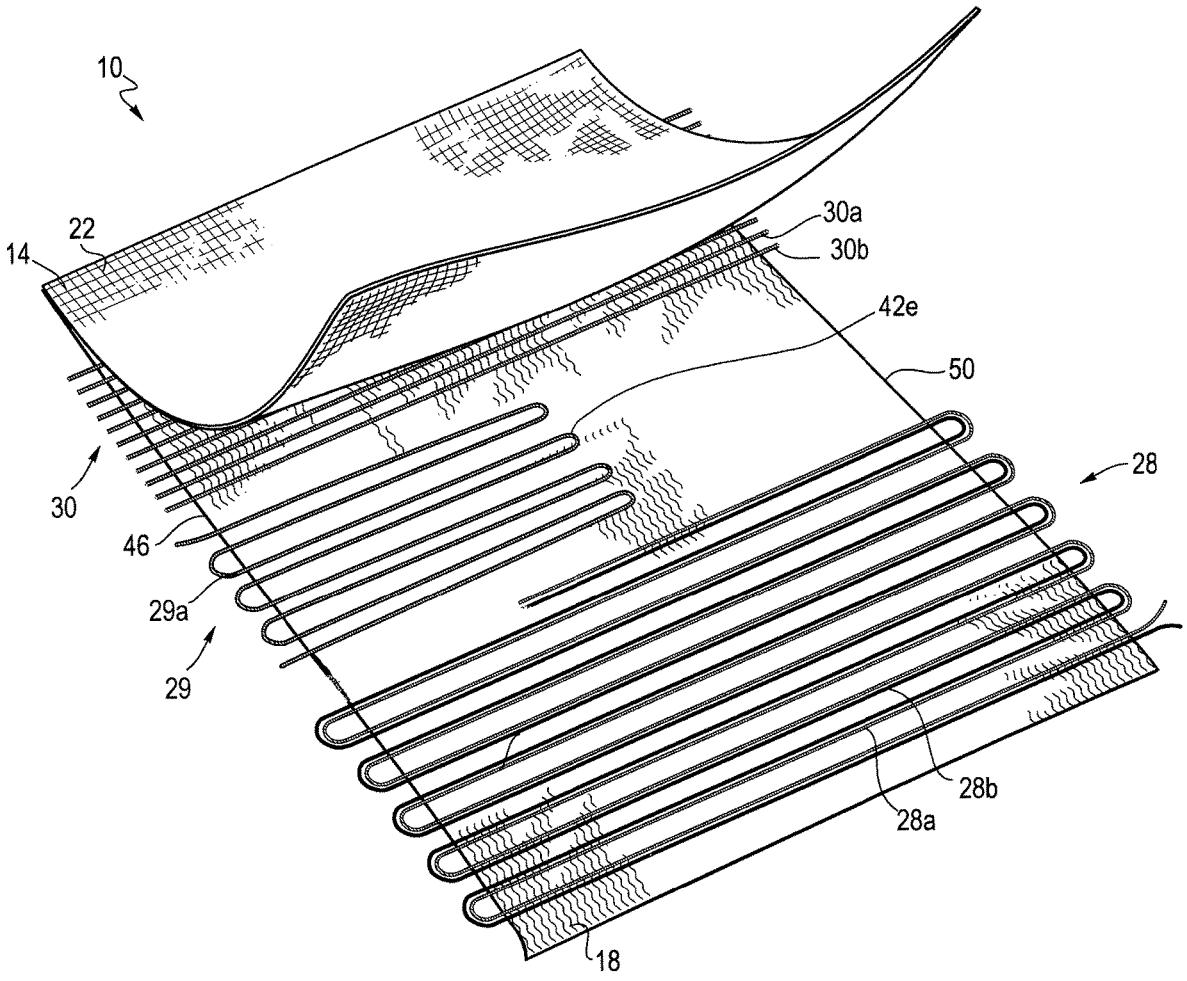
FIG. 2 shows a representative cutaway view of the knitted component of FIG. 1.

Referring still to FIG. 1 and also to the representative cutaway view of FIG. 2, knitted component 10 may include one or more pluralities of courses of yarn located between the first and second layers 14, 18 to reinforce the knitted component, improve strength (especially tensile strength), directional stretch resistance, to create an attractive appearance in certain embodiments, to increase resistance to penetration, and/or for other advantages. For example, knitted component 10 includes a first plurality of courses 28, a second plurality of courses 29, and a third plurality of courses 30. It will be appreciated that FIG. 2 is representative; although first layer 14 is illustrated as separated from second layer 18 in order to reveal pluralities of courses 28-30, first layer 14 need not be freely-separable from second layer 18. Pluralities of courses 28-30 may be formed between first and second layers 14, 18 as a result of the same process that forms first and second layers 14, 18; in other words, pluralities of courses 28-30 are part of the same, integrally-formed knitted component 10.

Pluralities of courses 28-30 may each include one or more yarns including a high tenacity yarn and may be formed by inlaying one or more yarns of the high tenacity yarn in between first and second layers 14, 18 that form the knitted component 10. In particular, pluralities of courses 28-30 may be formed at least partially from inlaid courses of high tenacity yarn. In this application, a yarn may be inlaid if it is placed in front of loops of some yarns and behind others (e.g., between loops formed on a first and a second needle bed). For example, an inlaid first yarn may be placed in front of loops of a second yarn being held on a first needle bed, and behind loops of the second yarn (or a third yarn) being held on a second needle bed. As another example, an inlaid first yarn may be placed in front of a first layer 14 and behind a second layer 18; in such cases, the first layer 14 and second layer 18 may or may not be freely separable. Subsequently, one or more yarns held on the first and second needle beds may be interlooped with additional courses of yarn and/or tucked on another needle bed, thus closing or securing the inlaid yarn within the knitted component 10 and effectively integrating the inlaid yarn into the integrally-knitted structure of the knitted component 10. In this way, an inlaid yarn may have portions that are not interlooped with other yarns of the knitted component, i.e., the inlaid yarn may have portions that may appear to extend straight through at least part of the knitted component 10. This may be accomplished on a knitting machine, e.g., with a combination feeder or an inlay feeder.

Figure 3A:
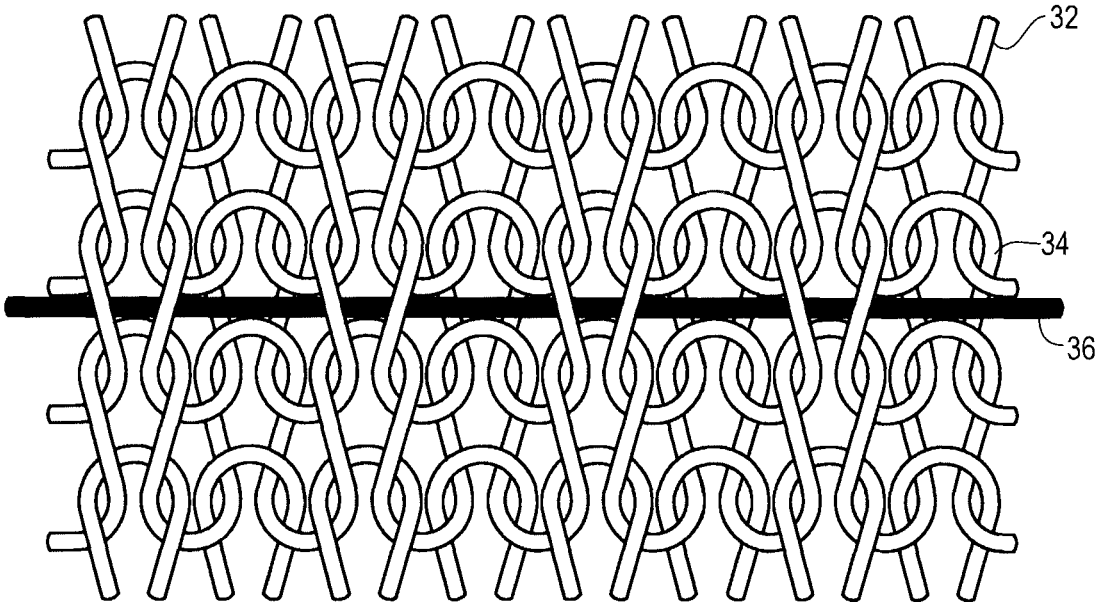
FIG. 3A show an inlaid course of a knitted component according to one aspect.
Figure 3B:
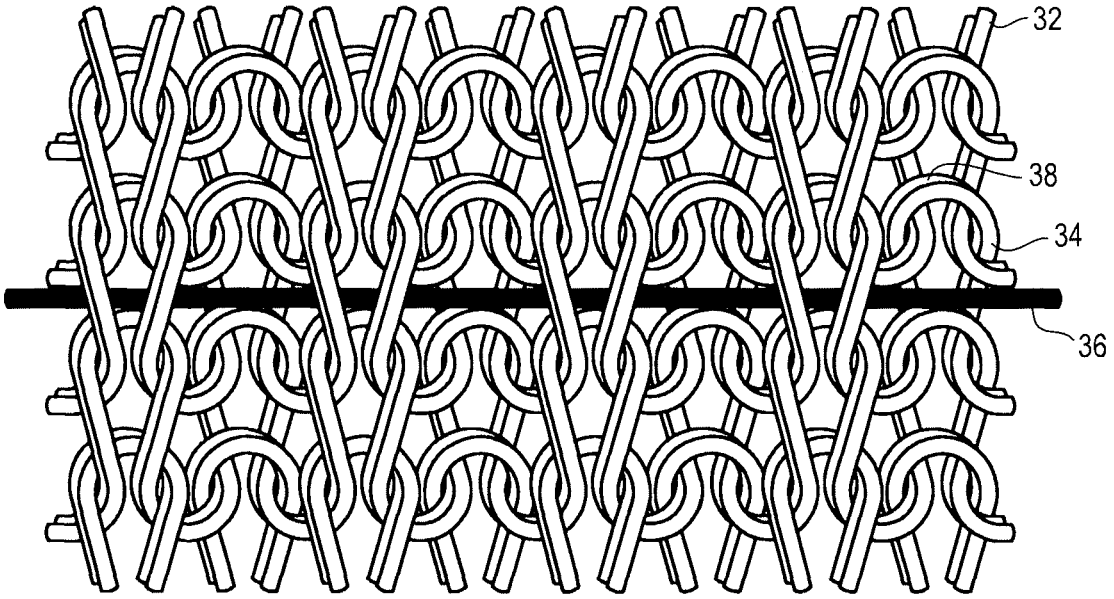
FIG. 3B shows another inlaid course of a knitted component according to another aspect.

Exemplary inlaid yarns are shown in FIGS. 3A-3B. In FIG. 3A, knitted component 32 includes a first yarn 34 that forms a plurality of intermeshed loops defining multiple horizontal courses and vertical wales. An inlaid yarn 36 extends along one of the courses and alternates between being located (a) behind loops formed from first yarn 34 and (b) in front of loops formed from first yarn 34. Although first yarn 34 forms each of the courses in this configuration, additional yarns may form one or more of the courses or may form a portion of one or more of the courses. Another example of a suitable configuration for a portion of knitted component 32 is depicted in FIG. 3B. In this configuration, knitted component 32 includes first yarn 34 and a second yarn 38 defining multiple courses and wales. As with the configuration in FIG. 3A, inlaid yarn 36 extends along one of the courses and alternates between being located (a) behind loops formed from yarns 34, 38 and (b) in front of loops formed from yarns 34, 38.

Generally, the courses of each plurality of courses of high tenacity yarn may have a spaced relationship. In one example, the plurality of inlaid courses may be closely spaced and in other examples the inlaid courses may be spaced relatively further from each other. The plurality of inlaid courses may be uniformly spaced from each other or the spacing may vary, with some inlaid courses spaced closely to adjacent inlaid courses while other inlaid courses are spaced further apart from adjacent inlaid courses.

As used in this application, two courses of high tenacity yarn may be closely spaced if separated by no more than ten courses of other yarns. In some examples, adjacent courses of inlaid high tenacity yarn may be spaced apart by no more than five, four, three, two, one, or zero courses of another yarn. For example, a first course and a second course of high tenacity yarn are closely spaced if the first course is inlaid in between loops of a first course of a second yarn, the second course of high tenacity yarn is inlaid between loops of a second course of the second yarn, and the first and second courses of the second yarn are separated by one, two, three, four, five, six, seven, eight, nine, or ten courses of the second yarn. As another example, first and second courses of high tenacity yarn are closely spaced (in fact, they are consecutive) if the first course of high tenacity yarn is inlaid in between loops of a first course of a second yarn, the second course of high tenacity yarn is inlaid between loops of a second course of the second yarn, and the first and second courses of the second yarn are adjacent (i.e., not separated by any courses).

The number of courses of high tenacity yarn may vary. For example, some embodiments may include one or more pluralities of high tenacity yarn, each having at least two, three, four, five, six, seven, eight, nine, ten, or a greater number of courses of high tenacity yarn. For example, first plurality of high tenacity courses 28 of FIGS. 1-2 includes more than ten courses 42 of high tenacity yarn (including courses 28*a, b*) that extend substantially through knitted component 10. Second plurality of high tenacity courses 29 includes fewer than ten courses (including course 29*a*).

Alternative embodiments may include greater or fewer pluralities of courses of high tenacity yarn. A greater number of courses of high tenacity yarn may provide greater reinforcement to the knitted component, and may correlate positively with the strength of the knitted component 10, and may also correlate with the stretch resistance of the knitted component 10 in directions approximately parallel to the direction of the courses of high tenacity yarn. Generally, at least some courses of high tenacity yarn may be full courses, such as courses 28*a, b* of first plurality 28, that extend from a first edge 46 of knitted component 10 to a second edge 50. Other knitted components may include courses extending both from a first edge to a second edge, and other courses extending from the second edge to a third edge. Alternatively, at least some courses of high tenacity yarn may be partial courses (i.e., extending an intermediate distance across a portion of the knitted component 10 or to a third edge in other embodiments), such as course 29*a* of second plurality 29. A knitted component may include both full and partial courses of high tenacity yarn. Further, each course of high tenacity yarn may be formed by one continuous yarn (such as courses 28*a, b* of first plurality 28, which extend across at least a portion of knitted component 10 in a snake-like or zig-zag pattern), or by distinct, individual ends of yarn (such as courses 30*a, b* of third plurality 30). In either case, one or more courses of high tenacity yarn may extend beyond one or more edges of knitted component 10, such as courses 28*a, b* (which form a loop or hair-pin-like turn, for example, to extend back through the knitted component two or more times in such a pattern) and courses 30*a, b*.

Figure 4A:
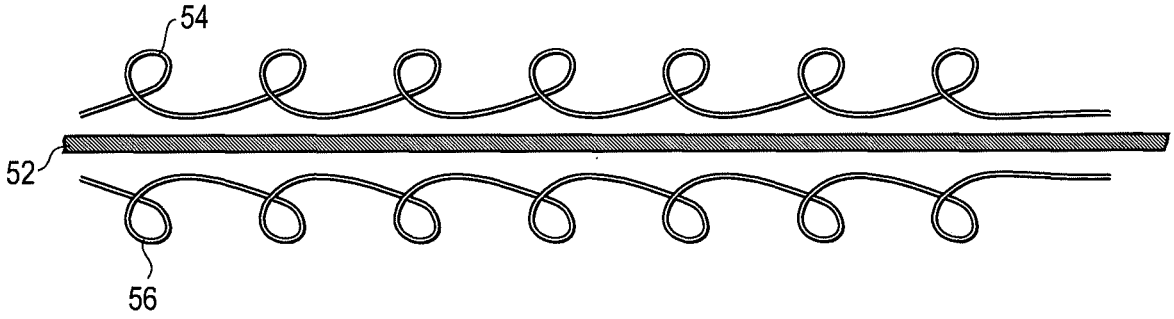
FIG. 4A shows an inlaid course of another knitted component according to another aspect.
Figure 4B:
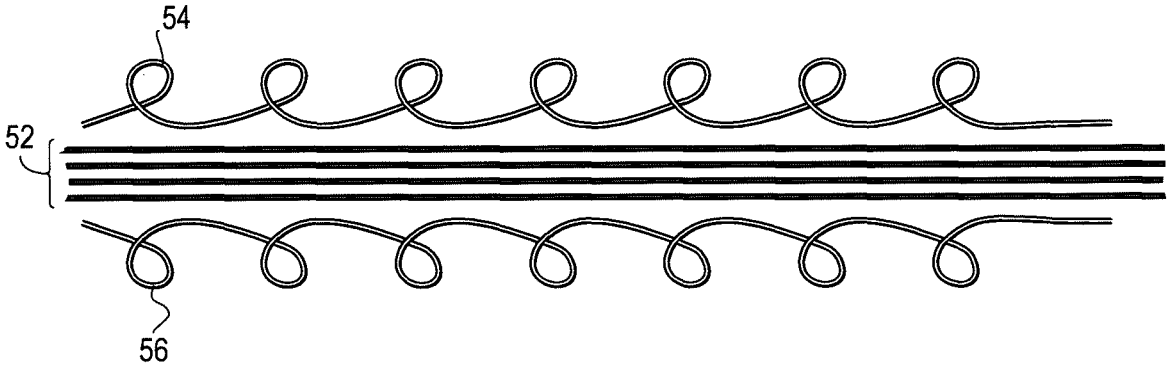
FIG. 4B shows another inlaid course of the knitted component of FIG. 4A.

Suitable high tenacity yarns may include polyester and other compositions formed into yarns having a tenacity in the range of at least approximately six grams-force per denier, e.g., approximately 6-10 grams-force per denier. For example, polyester yarns having linear densities ranging from approximately 275-325 denier and a maximum tensile strength of at least 1,650 grams-force may be appropriate. To facilitate knitting, in some embodiments, each course of the high tenacity yarn may have a maximum diameter of less than or equal to approximately 1.0 mm, e.g., less than or equal to 0.9 mm, 0.8 mm, 0.7 mm, 0.6 mm, 0.5 mm, or a smaller diameter. One suitable high tenacity yarn is a 300 denier polyethylene terephthalate yarn having a maximum tensile strength of 1,800 grams-force and thus, a tenacity of 6 grams-force per denier. Each course of high tenacity yarn may utilize a single yarn or strand. Or, each course of high tenacity yarn may comprise a plurality of yarns or strands such that each course of high tenacity yarn has greater maximum tensile strength and denier, and therefore higher tenacity. Referring to FIG. 4A, course 52 of high tenacity yarn extends in between first and second layers 54, 56 and includes a single end of high tenacity yarn, e.g., a single end of 1000-denier high tenacity yarn having a 6,000 grams-force maximum tensile strength. By comparison, FIG. 4B illustrates a single course 54 of high tenacity yarn that includes four ends of high tenacity yarn, e.g., four ends of 300-denier, 1,800 grams-force yarns of high tenacity yarn. Although FIGS. 4A-B are representative, in other embodiments, each course of high tenacity yarn may include two, three, four, five, six, ten, or a greater number of yarns of high tenacity yarn. The multiple ends of high tenacity yarn may be twisted, braided, formed in a core/sheath relationship, or otherwise combined together to form a course of high tenacity yarn. As yet another example, a course of high tenacity yarn may utilize three ends of 275 denier yarn, with each yarn having a maximum tensile strength of 1,925 grams-force, thereby forming a course of high tenacity yarn having an 825 denier and maximum tensile strength of 5,775 grams-force. As yet another example, a course of high tenacity yarn may utilize four ends of 300 denier yarn, each yarn having a maximum tensile strength of 1,800 grams-force, producing a course of high tenacity yarn having 1,200 denier and maximum tensile strength of 7,200 grams-force. Altogether, each course of high tenacity yarn (including all yarns utilized to form the course) may have a total linear density of at least approximately 750 denier (e.g., at least 1,000 denier) and a maximum tensile strength of at least approximately 4,500 grams-force (e.g., at least 7,000 grams-force).

Figure 5A:
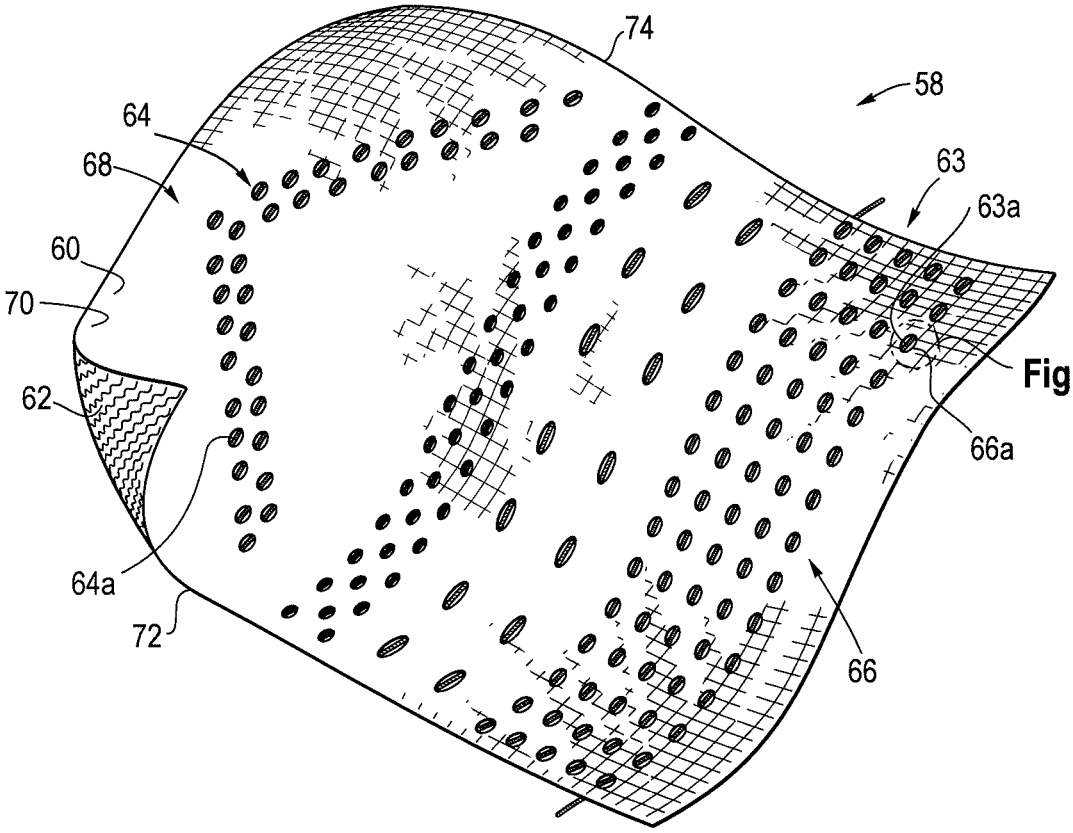
FIG. 5A shows a knitted component according to another aspect.
Figure 5B:
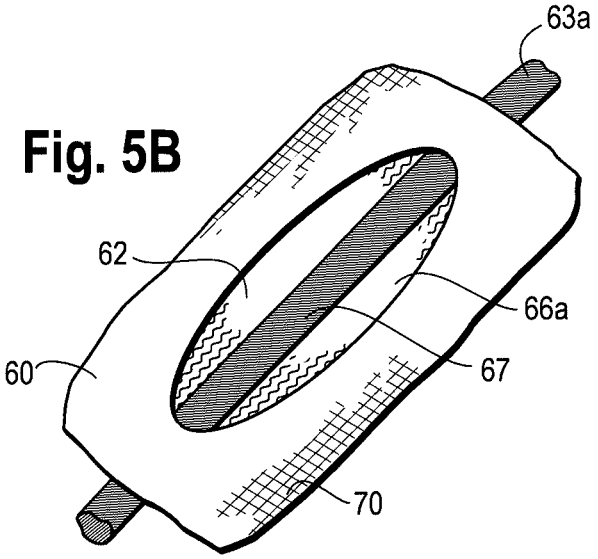
FIG. 5B shows an enlarged detail view of a portion of the knitted component of FIG. 5A.

In the alternative embodiment of FIG. 5A, a knitted component 58 includes a first layer 60, a second layer 62, a first plurality of courses of high tenacity yarn 63 (e.g., course 63*a*) and a second plurality of courses of high tenacity yarn 64 (e.g., course 64*a*). First layer 60 includes a first plurality of apertures 66 (e.g., aperture 66*a*) and a second plurality of apertures 68. First plurality of apertures 66 extends in a course-wise direction, and each aperture of first plurality 66 has, as one example, a longest dimension that is oriented in the course-wise direction, as shown in detail view FIG. 5B. It will be appreciated that each aperture of the first plurality of apertures 66 could have other shapes, orientations, and dimensions. At least an exposed portion of at least one course of high tenacity yarn (e.g., exposed portion 67 of course 63*a*) is exposed through each aperture of first plurality 66. If the high tenacity yarn has a different color and/or other different visual property relative to the yarn(s) that form first layer 60, then the exposed portions of high tenacity yarn may provide an appealing visual appearance. The exposed portion of high tenacity yarn may be recessed relative to a first surface 70 of knitted component 58 (e.g., which may correspond with an outermost or exterior surface of the knitted component 58), or the exposed portion of high tenacity yarn may protrude through one or more of the plurality of apertures 66.

The second plurality of apertures 68, as one example, forms a pattern that extends diagonally relative to first and second edges 72, 74 of knitted component 58. Each aperture of second plurality 68 has an elongate shape extending in a course-wise direction; thus, each aperture has a different orientation than the second plurality 68 as a whole. Each aperture of the second plurality of apertures 68 could have other suitable shapes, orientations, and dimensions. Advantageously, second plurality of apertures 68 may provide a visual impression that the high tenacity yarn extends in the direction(s) of the pattern (i.e., diagonally in FIG. 5A), when in fact each course of high tenacity yarn extends in another direction (i.e., a course-wise direction). In other words, in FIG. 5A, the high tenacity yarn appears to extend diagonally, although each course (e.g., course 64*a*) of high tenacity yarn has a course-wise orientation that is not diagonal.

Figure 6:
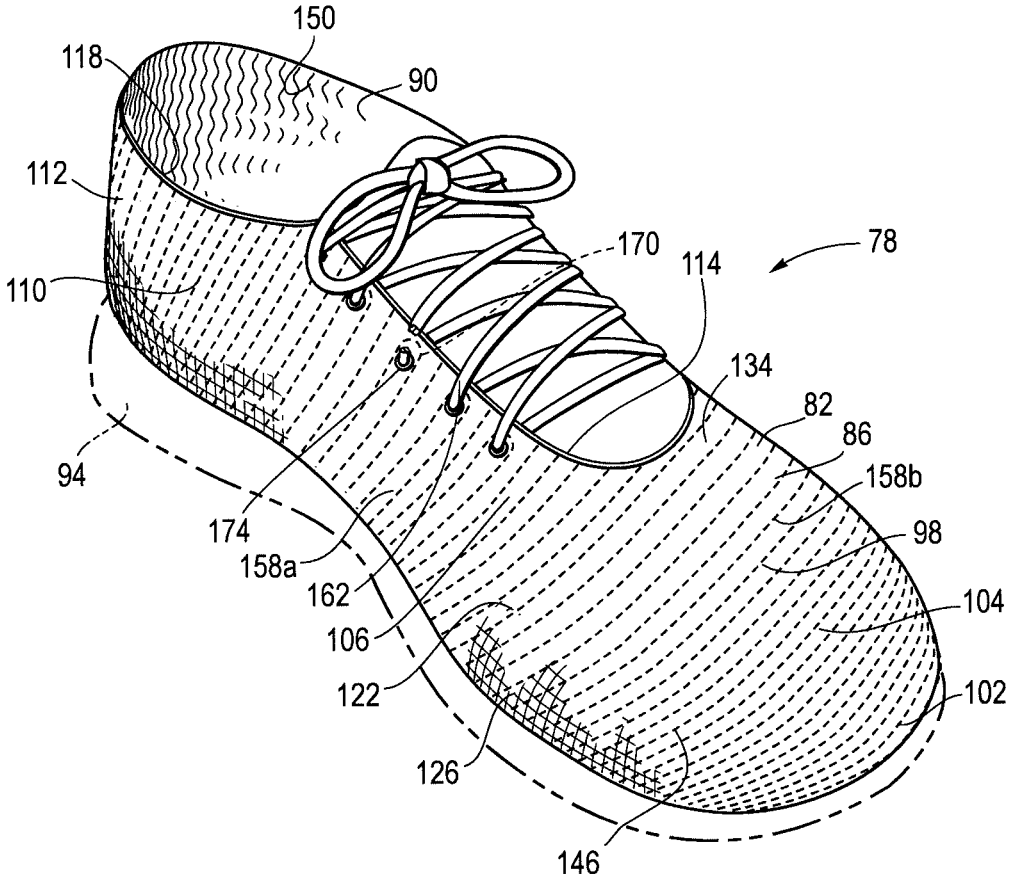
FIG. 6 shows an article of footwear according to one aspect.

The knitted components described above have a wide range of useful applications, including footwear, apparel, and industrial textiles. As one non-limiting example, FIG. 6 illustrates an article of footwear 78 that includes an upper 82 at least partially formed with a knitted component 86 as described above. Article of footwear 78 has a general configuration suitable for walking or running. Concepts associated with footwear, including upper 82 and knitted component 86, may also be applied to a variety of other athletic footwear types, including but not limited to baseball shoes, basketball shoes, cross-training shoes, cycling shoes, football shoes, soccer shoes, sprinting shoes, tennis shoes, and hiking boots. The concepts may also be applied to footwear types that are generally considered to be non-athletic, including dress shoes, loafers, sandals, and work boots. The concepts disclosed herein apply, therefore, to a wide variety of footwear types. In the embodiment of FIG. 6, upper 82 may generally provide a comfortable and secure covering for a wearer's foot. As such, upper 82 may define a void 90 to effectively receive and secure a foot within article 78. Moreover, an optional sole structure 94 may be secured to a lower area of upper 82 and may extend between a wearer's foot and the ground to attenuate ground reaction forces (i.e., cushion the foot), provide traction, enhance stability, and influence the motions of the foot.

For reference purposes, article 78 may be divided generally along a longitudinal direction (heel-to-toe) into three general regions: a forefoot region 98 including a forefoot edge region 102 and a toe box 104, a midfoot region 106, and a rearfoot region 110 including a heel region 112. Forefoot region 98, in particular toe box 104, may generally include portions of upper 82 that may eventually cover (when incorporated into an article of footwear) the toes and the joints connecting the metatarsals with the phalanges. Midfoot region 106 may generally include portions corresponding with an arch area of the foot, and may include a throat region 114. Rearfoot region 110, in particular heel region 112, may generally correspond with rear portions of the foot, including areas that cover the calcaneus bone (which comprises a portion of a wearer's heel). Additionally, in some embodiments, rearfoot region 110 may cover some or all of the wearer's malleoli and talus (which comprise a portion of the ankle). Rearfoot region 110 may coincide with a collar region 118. Upper 82 may also include a medial side 122 having a medial edge region 126 (including a medial edge 130), and a lateral side having a lateral edge region (including a lateral edge). Each of the medial side 122 and lateral sides may extend through each of forefoot region 98, midfoot region 106, and rearfoot region 110, and may correspond with opposite sides. More particularly, lateral side may correspond with an outside area of the foot (i.e., the surface that faces away from the other foot), and medial side 126 may correspond with an inside area of the foot (i.e., the surface that faces toward the other foot). Forefoot region 98, midfoot region 106, rearfoot region 110, medial side 122, and lateral side are not intended to demarcate precise areas of upper 82 or knitted component 86, but rather are intended to represent general areas to aid in the following discussion.

In FIG. 6, knitted component 86 of article 78 includes an exterior layer 146, and interior layer 150, and a plurality of courses of high tenacity yarn 158 (shown in hidden lines, e.g., 158*a, b*) formed between exterior and interior layers 146, 150. Plurality of courses 158 may advantageously reinforce knitted component 86, for example by increasing its strength and increasing stretch resistance in a particular direction, such as the medial-lateral direction and/or a forefoot-rearfoot direction, and improve lock-out of a wearer's foot such as during athletic activities that require side-to-side cutting movements (e.g., basketball and soccer). In the embodiment of FIG. 6, the plurality of courses 158 (e.g., 158*a, b*) of high tenacity yarn extends substantially throughout upper 82 on both the lateral side and medial sides 126, extending from rearfoot region 110, to midfoot region 106, to forefoot region 98. In other embodiments, one or more pluralities of courses of high tenacity yarn (including one or more pluralities of courses of high tenacity yarn) may exist in one or more regions, areas, portions, sides, or other locations of the upper, including those described above. Exterior and interior layers 146, 150 may conceal at least a portion of the plurality of courses of high tenacity yarn 158, although in other embodiments, apertures in the exterior and interior layers may expose a portion of the plurality of courses of high tenacity yarn. In other embodiments, the exterior layer may include one or more features other than apertures, for example raised knit structures forming a pattern (e.g., elongate and parallel knit structures, which may extend in a number of directions, e.g., diagonally relative to sole structure 94), depressions, etc. The plurality of courses of high tenacity yarn 158 may also interact with a fastening system 162. In particular, apertures of fastening system 162 may extend through the plurality of courses 158, thereby adding strength to fastening system 162. In one example, a looped portion 170 of high tenacity yarn may loop around one or more lace apertures 174, such that when a lace if fed through the aperture(s), it also extends through the loop formed by the high tenacity yarn.

Referring still to FIG. 6, course 158*a* of high tenacity yarn is a partial course that extends from medial edge region 130 to throat region 114 in a medial-lateral orientation. By comparison, course 158*b* is a full course of high tenacity yarn that extends from the lateral side to medial side 122, i.e., from the lateral edge region to medial edge region 130. In other embodiments, courses of high tenacity yarn may exist in one or more localized portions of the upper, e.g., in midfoot region 106, forefoot region 98, and/or rearfoot region 110. Likewise, in other embodiments, courses of high tenacity yarn may have orientations other than the medial-lateral orientation. For example, the courses of high tenacity yarn may be oriented in a direction in which it is desirable to increase stretch resistance in that same direction, e.g., a forefoot-rearfoot direction or a direction oblique to sole structure 94.

Figure 7A:
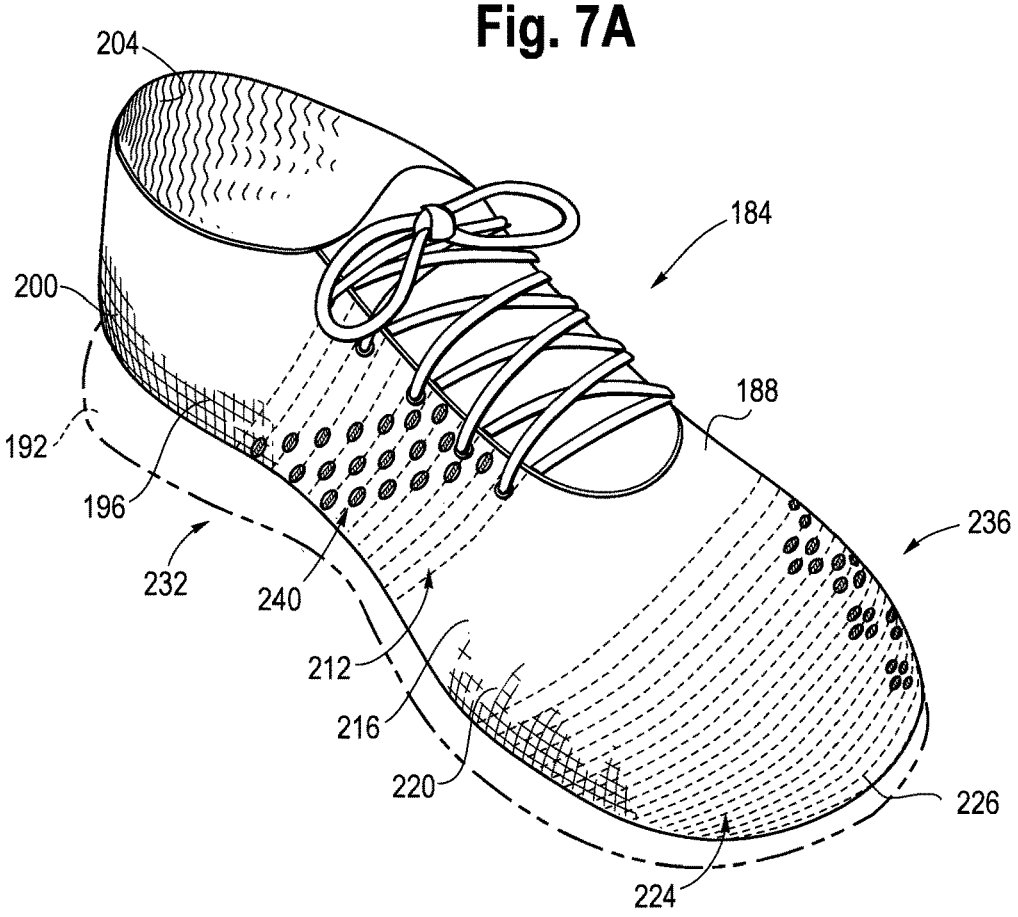
FIG. 7A shows an article of footwear according to another aspect.
Figure 7B:
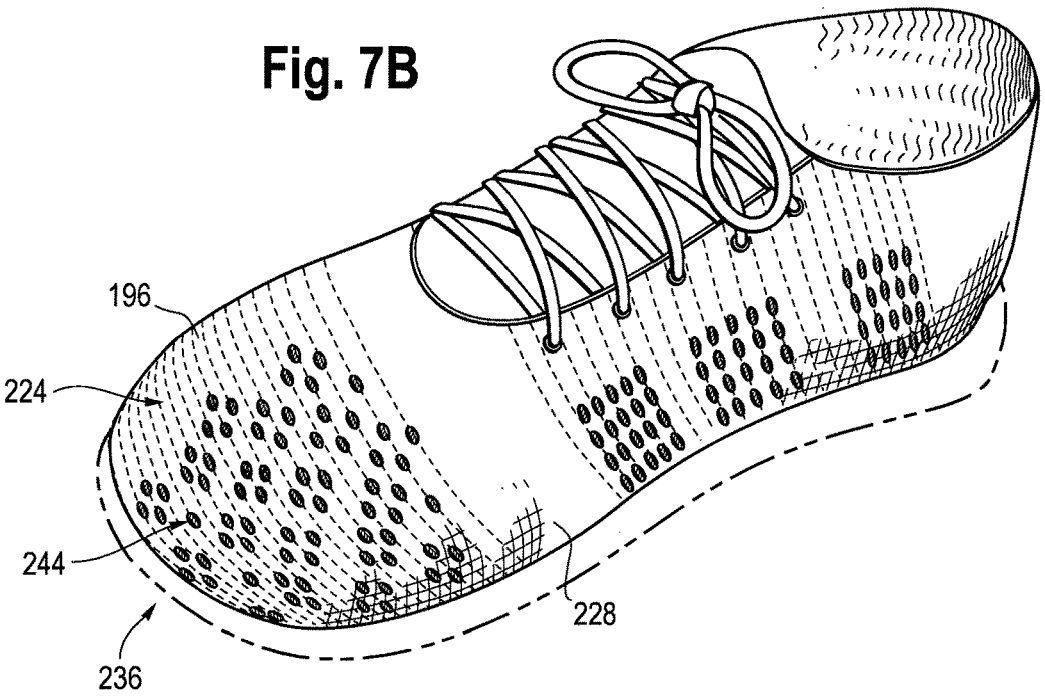
FIG. 7B shows another view of the article of footwear of FIG. 7A.

FIGS. 7A-B show an alternative article of footwear 184 that includes an upper 188 joined with an optional sole structure 192, the upper 188 being at least partially formed with a knitted component 196 that is constructed as described above. Knitted component 196 includes an exterior layer 200, and interior layer 204, and a first plurality of courses 212 of high tenacity yarn formed in between the exterior layer 200 and the interior layer 204. The first plurality is 212 is located in a midfoot region 216 on a medial side 220, and a second plurality of courses 224 of high tenacity yarn located in a forefoot region 226 spanning into both the medial side 220 and a lateral side 228. The locations and dimensions of first and second pluralities 212, 224 are merely exemplary; other embodiments may include one or more pluralities of high tenacity yarn with various dimensions that at least partially occupy one or more of any of the regions discussed above. The first and second pluralities 212, 224 of courses of high tenacity yarn may form part of a first and a second high tenacity zone 232, 236, respectively, i.e., localized areas of article 184 that each include a plurality of courses of high tenacity yarn and other structures for the benefits of reinforcement, added strength, and increased stretch resistance provided by the high tenacity yarn. In other embodiments, greater or fewer high tenacity zones may exist in the same or different locations than those locations shown in FIGS. 7A-B.

In FIGS. 7A-B, the high tenacity yarn utilized in the first plurality of high tenacity yarns 212 has at least one different visual property than the material(s) utilized to form exterior layer 200 (e.g., reflectivity, and/or a different color or texture). First high tenacity zone 232 includes a first plurality of apertures 240 formed in exterior layer 200 that together extend in a diagonal direction relative to sole structure 192 on medial side 220 and overlap with first plurality 212 of courses of high tenacity yarn. Each aperture of the first plurality of apertures 240 has a medial-lateral orientation. In other embodiments, one or more pluralities of apertures may extend in a number of directions or form a number of different patterns, and each aperture may have a number of different individual orientations, and a number of individual shapes. Each aperture of the first plurality of apertures 240 exposes a portion of at least one course of first plurality of courses 212 of courses of high tenacity yarn. Consequently, the exposed portion of high tenacity yarn (which has at least one different visual property relative to exterior layer 200) is visible through the first plurality of apertures 240. In other embodiments, the exposed portion of high tenacity yarn may be recessed relative to a first surface of the exterior layer (which may correspond with an outermost surface of the article of footwear). Furthermore, first plurality of apertures 240 may provide a visual impression that the first plurality 212 of courses high tenacity yarn extends in a diagonal direction, when in fact each course of high tenacity yarn extends in a medial-lateral direction. This may be the result of the first plurality of apertures 240 being formed in a generally diagonal orientation as shown in FIG. 7A, where each consecutive aperture exposes at least a portion of one or more courses of high tenacity yarn. In other words, each consecutive aperture in a particular diagonal line of apertures may expose a different course of high tenacity yarn.

Second high tenacity zone 236 includes a second plurality of apertures 244 formed in exterior layer 200 and located in forefoot region 226 that together form an "X" or diamond pattern and coincide with second plurality 224 of courses of high tenacity yarn. The apertures are shown as oblong or oval, but may have a variety of shapes, orientations, and dimensions as desired in other embodiments. Because each aperture of the second plurality 244 of apertures exposes a portion of at least one course of second plurality 224 of courses of high tenacity yarn, knitted component 196 may provide a visual impression that the second plurality 224 of courses of high tenacity yarn extends in diagonal directions forming an "X" or diamond pattern, when in fact each course of high tenacity yarn of the second plurality 224 extends in a medial-lateral direction. In other embodiments, different aperture arrangements in the exterior layer and different visual properties of the exterior layer and of the portion of high tenacity yarn that is exposed through one or more of the apertures may produce a wide range of different patterns and visual effects.

Figure 8:
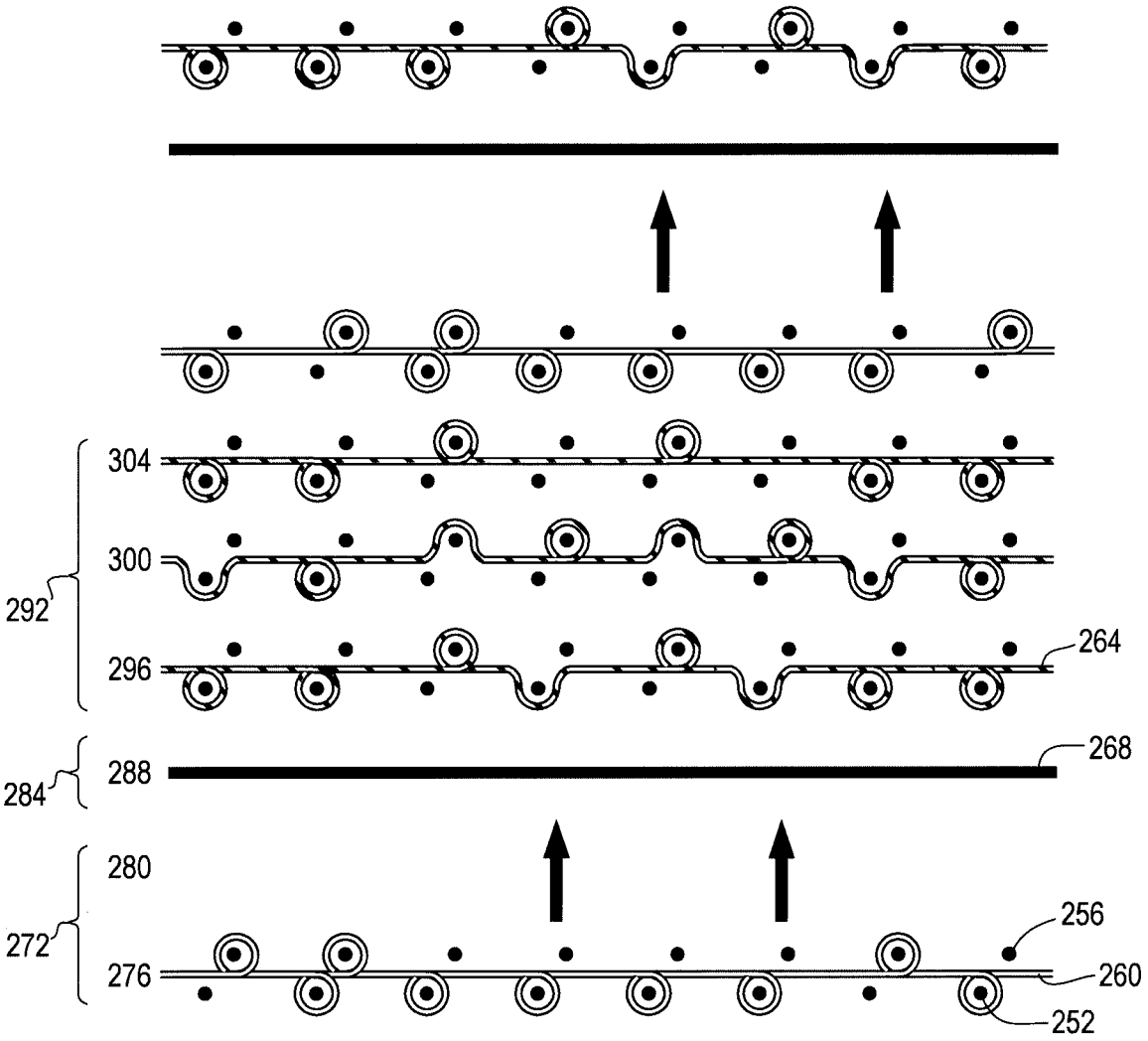
FIG. 8 illustrates a knitting sequence according to one aspect.

FIG. 8 illustrates a knitting sequence that may be utilized to form integrally-knitted components as described above, such as through a weft knitting process (e.g., with a flat knitting machine with one, two, or more needle beds). The non-limiting sequence of FIG. 8 is illustrated on a weft knitting machine having a first needle bed 252 and a second needle bed 256. The knitting sequence illustrates the formation of a first layer, an overlapping second layer, and a plurality of courses of high tenacity yarn 268 in between. The exterior layer and interior layers are at least partially formed from a first yarn 260 and a second yarn 264. Notably, it is not necessary to utilize both first and second yarns 260, 264, as a single yarn could form both the first and second layers; however, different yarns are illustrated to better communicate spacing between courses of high tenacity yarn 268. The knitting process forms a plurality of courses of high tenacity yarn, advantageously increasing the strength and course-wise stretch resistance of the resulting knitted component. Furthermore, the non-limiting sequence of FIG. 8 includes forming a plurality of apertures in the first layer to expose the high tenacity yarn 268.

In a first step 272, the machine forms a course 276 of first yarn 260 on both the first and second needle beds 252, 256 (forming part of the first and second layers), and executes transfers 280 to form apertures in the first layer. To prepare for the transfers 280, course 276 does not knit any loops on needles of second needle bed 256 that correspond with locations where apertures will later be formed in the first layer. Subsequent to course 276, transfers 280 move knit loops formed on first needle bed 252 in course 276 to second needle bed 256.

In a second step 284, a course 288 of high tenacity yarn 268 is inlaid between loops previously formed on first and second needle beds 252, 256 during course 276. As discussed above, course 288 may include one or more ends of high tenacity yarn 268. Following second step 284, first step 272 and second step 284 may be repeated as desired to make the knitted component larger by adding more courses to the first and second layers and by inlaying additional courses of high tenacity yarn 268.

In a third step 292, the knitting machine knits three courses 296, 300, 304 of second yarn 264 on first and second needle beds 252, 256, thereby making the knitted component larger. At course 296, the machine forms tucks of second yarn 264 on first needle bed 252 at locations corresponding to the front-to-rear transfers executed at first step 272, thereby securing inlaid course 288 of high tenacity yarn formed during second step 284 within the knitted component.

Following third step 292, first through third steps 272-292 may be repeated as necessary to make the knitted component larger and to inlay additional courses of high tenacity yarn 268. The location of transfers and tucks may be altered to adjust the location of apertures formed in the first layer; alternatively, the transfers and tucks may be eliminated if no apertures are desired, although the tucks may advantageously secure the inlaid courses of high tenacity yarn. Regardless, the resulting knitted component would include first and second layers and a plurality of inlaid courses of high tenacity yarn 268. The courses of high tenacity yarn 268 in FIG. 8 are closely spaced because a course of high tenacity yarn 268 is inlaid on top of each of course of first yarn 260 which, in this case, are separated by just three courses of second yarn 264. In other embodiments, courses of high tenacity yarn may have closer spacing, e.g., inlaid after every course (consecutive). Alternatively, courses of high tenacity yarn may be spaced apart to a greater degree without deviating from the present disclosure, e.g., spaced apart by up to four, five, six, seven, eight, nine, or ten courses of yarn. In other embodiments, the size of the apertures may be greater to increase the exposed portion of high tenacity yarn, e.g., by transferring knit loops from two, three, or more consecutive needles on the first needle bed to the second needle bed.

Knitted components constructed as described above may impart numerous advantages to uppers, articles of footwear, apparel, industrial textiles, and other applications. In particular, one or more pluralities of courses of high tenacity yarn may reinforce and increase the strength of the knitted component, especially in directions parallel to and approximately parallel to the courses of high tenacity yarn. This may be useful in articles of footwear, where selective placement of such knitted components may improve directional stability. Additionally, the courses of high tenacity yarn may increase stretch resistance in directions parallel to and approximately parallel to the courses of high tenacity yarn, e.g., for the benefit of improving lock-out of a wearer's foot in an article of footwear. Additionally, when a first layer includes one or more apertures, thereby exposing a portion of the high tenacity yarn, the knitted component may have appealing visual properties; for example, a plurality of apertures in the first layer may form a pattern that conveys the appearance that courses of high tenacity yarn extend in a first direction, even though they in fact extend in a second direction.

While various embodiments of the present disclosure have been described, the present disclosure is not to be restricted except in light of the attached claims and their equivalents. Moreover, the advantages described herein are not necessarily the only advantages of the present disclosure and it is not necessarily expected that every embodiment of the present disclosure will achieve all of the advantages described.

We claim:

1. A knitted component, comprising:

a first knit layer comprising a first yarn;

a second knit layer;

a first plurality of inlaid courses of a high tenacity yarn having a tenacity of at least six grams-force per denier; wherein the first plurality of inlaid courses of the high tenacity yarn comprise at least three courses of high tenacity yarn, each of which is separated from an adjacent course of the first plurality of courses by no more than five courses of the first yarn; and, a plurality of openings formed in the first knit layer, through which exposed portions of the plurality of inlaid courses of the high tenacity yarn are visible from a viewpoint facing the first knit layer;

wherein the plurality of openings forms a pattern, at least a portion of which has an orientation other than a course-wise direction or a wale-wise direction, in which adjacent openings of the plurality of openings expose different inlaid courses of the high tenacity yarn.

2. The knitted component of claim 1, wherein at least one course of the first plurality of inlaid courses of the high tenacity yarn has a diameter of less than or equal to 0.9 mm.

3. The knitted component of claim 1, wherein the first plurality of courses of the high tenacity yarn comprises at least five courses of the high tenacity yarn.

4. The knitted component of claim 1, wherein each course of the first plurality of inlaid courses of the high tenacity yarn has a linear density of at least 1,000 denier.

5. The knitted component of claim 1, wherein each course of the first plurality of courses of the high tenacity yarn has a maximum tensile strength of at least 7,000 grams-force.

6. The knitted component of claim 1, further comprising a second plurality of inlaid courses of the high tenacity yarn having a tenacity of at least six grams-force per denier.

7. The knitted component of claim 6, wherein at least one course of the first plurality of inlaid courses extends from a first edge of the knitted component toward a second edge of the knitted component, wherein at least one course of the second plurality of inlaid courses extends from the second edge of the knitted component toward a third edge of the knitted component.

8. The knitted component of claim 6, wherein at least one course of the first plurality of inlaid courses extends from a first edge of the knitted component toward a second edge of the knitted component, wherein at least one course of the second plurality of inlaid courses extends from the second edge of the knitted component toward the first edge of the knitted component.

9. The knitted component of claim 8, wherein the at least one course of the first plurality of inlaid courses extends part way to the second edge of the knitted component, wherein the at least one course of the second plurality of inlaid courses extends part way to the first edge of the knitted component.

10. The knitted component of claim 8, wherein the at least one course of the first plurality of inlaid courses extends past the at least one course of the second plurality of inlaid courses.

11. The knitted component of claim 8, wherein the at least one course of the first plurality of inlaid courses extends from the first edge of the knitted component to the second edge of the knitted component.

12. The knitted component of claim 1, wherein the first knit layer conceals one or more of the plurality of inlaid courses.

13. The knitted component of claim 1, wherein the first knit layer and the second knit layer are at least partially formed from the first yarn.

14. The knitted component of claim 1, wherein at least one course of the plurality of inlaid courses is secured to at least one of the first and second knit layers with a tuck stitch.

15. The knitted component of claim 1, wherein the high tenacity yarn and the first yarn have at least one different visual property.

16. The knitted component of claim 15, wherein the high tenacity yarn and the first yarn have different colors.

17. The knitted component of claim 1, wherein the exposed portions are recessed relative to a first surface of the first knit layer.

18. A method of forming a knitted component, comprising:

knitting a first course of a first yarn on a first needle bed and a second needle bed;

inlaying a first course of a high tenacity yarn having a tenacity of at least six grams-force per denier in between the first and second needle beds;

inlaying a second course of the high tenacity yarn in between the first and second needle beds; and inlaying a third course of the high tenacity yarn in between the first and second needle beds;

forming a plurality of openings in the knitted component, through which exposed portions of the first course, the second course, and the third course of the high tenacity yarn are visible from a view point facing the plurality of openings;

wherein the first and second courses of the high tenacity yarn are separated from each other by no more than five courses;

wherein the second and third courses of the high tenacity yarn are separated from each other by no more than five courses; and, wherein the plurality of openings forms a pattern, at least a portion of which has an orientation other than a course-wise direction or a wale-wise direction, in which a first opening of the plurality of openings exposes the first course of the high tenacity yarn, a second opening of the plurality of openings exposes the second course of the high tenacity yarn, and a third opening of the plurality of openings exposes the third course of the high tenacity yarn.

* * * * *